US008961253B1

(12) United States Patent
Schultz et al.

(10) Patent No.: US 8,961,253 B1
(45) Date of Patent: Feb. 24, 2015

(54) PERSONAL FLOATATION DEVICE WITH FLOAT CHAIR AND KAYAK MOUNTING FEATURES

(76) Inventors: Douglas James Schultz, Oakland Park, FL (US); Justin Rietema, Oakland Park, FL (US)

( * ) Notice: Subject to any disclaimer, the term of this patent is extended or adjusted under 35 U.S.C. 154(b) by 29 days.

(21) Appl. No.: 13/607,914

(22) Filed: Sep. 10, 2012

Related U.S. Application Data

(63) Continuation-in-part of application No. 13/416,882, filed on Mar. 9, 2012, now abandoned.

(51) Int. Cl.
*B63C 9/30* (2006.01)
*B63C 9/115* (2006.01)
*B63B 17/00* (2006.01)

(52) U.S. Cl.
CPC ..... *B63C 9/115* (2013.01); *B63B 17/00* (2013.01)
USPC ..... 441/120; 441/126

(58) Field of Classification Search
USPC ..... 441/102, 126, 115, 117, 120
IPC ..... B63C 9/13
See application file for complete search history.

(56) References Cited

U.S. PATENT DOCUMENTS 5,152,706 A * 10/1992 Fister ..... 441/106
5,459,874 A * 10/1995 Meredith ..... 2/67
5,785,568 A * 7/1998 Lake ..... 441/127
6,786,786 B1 * 9/2004 Davis ..... 441/120

* cited by examiner

*Primary Examiner* — Stephen Avila
(74) *Attorney, Agent, or Firm* — Oltman, Flynn & Kubler

(57) ABSTRACT

A floatation garment includes a front panel formed of a front panel sheet of elastic material tapering inwardly at the front panel sheet lower end and having series of buoyant members which are laterally spaced apart and contained within the front panel sheet, and a generally horizontal front securing strap having front strap connection means at opposing strap ends and a rear panel formed of rear panel sheet also tapering inwardly at the rear panel sheet lower end and also having a generally horizontal rear securing strap having rear strap connection means at opposing strap ends positioned to connect to corresponding front strap connection means, the front and rear panel sheets preferably being interconnected at the front and rear panel sheet lower ends by an elastic connecting segment to form a single, continuous garment sheet.

10 Claims, 12 Drawing Sheets

PERSONAL FLOATATION DEVICE WITH FLOAT CHAIR AND KAYAK MOUNTING FEATURES

This application is a continuation-in-part of application Ser. No. 13/416,882 filed on Mar. 9, 2012, now abandoned.

BACKGROUND OF THE INVENTION

1. Field of the Invention

The present invention relates generally to the field of floatation devices such as for safety and entertainment. More specifically the present invention relates to a floatation garment, a first embodiment of which includes a garment front sheet of elastic material such as neoprene and having a wider forward sheet portion with a series of front buoyant member pockets each containing front buoyant member, the front garment sheet tapering downwardly at its lower end. The front buoyant members and their member pockets preferably are provided in parallel and spaced apart upper and lower series respectively. The upper and lower series permit the front sheet to bend along a horizontal line between the series to permit the wearer to bend forward at the waist. The garment further includes a garment rear sheet preferably of the same elastic material as the front sheet and having a single series of rear buoyant member pockets each containing a rear buoyant member which preferably is at least as tall as two of the front buoyant members combined. The garment rear sheet also tapers downwardly from its lower end and meets and connects to the tapered lower end of the garment front sheet to define a connecting segment for passing between the wearer legs, preferably integral with the front and rear sheets to define a single, continuous garment sheet. The front garment sheet preferably is more buoyant than the rear garment sheet so that the wearer faces up if he or she is unconscious in the water.

Upper and lower front sheet straps or belts, respectively, extend generally horizontally across and laterally from the front sheet and have fastening mechanisms such as buckles or clasps at their front strap free ends. Upper and lower rear sheet securing straps, respectively, extend generally horizontally across and laterally from the rear sheet. Each rear sheet securing strap has a rear strap connection mechanism at opposing rear strap free ends positioned to connect to a corresponding front strap connection mechanism.

The front sheet preferably is shorter than the rear panel and terminates between the chest and abdominal area of the wearer below the level of the rear sheet so that the wearer is further unrestricted in bending at the waist. Greater buoyancy is provided in the front sheet, and to keep the wearer more upright in the water and face up if unconscious in the water.

The respectively interconnected front sheet straps preferably are extendable so that the garment can be opened to and locked at a point at which the front sheet and rear sheet extend substantially at 90 degrees relative to each other so that the garment is open to an extent to define a float chair. A person can sit in the float chair as it floats in water by sitting against the connecting segment while placing his or her back against the inward side of the rear garment sheet and upper legs against the inward side of the front garment sheet.

Another feature is provided to secure the float chair as it rests on the floor of a kayak. A series of kayak strap loops preferably are fastened to the back surface of the rear sheet. A kayak strap is provided of sufficient length to pass through the series of strap loops and extend from either side of the garment to the upper sides of a kayak. Each end of the kayak strap includes a fastening mechanism for dipping to an oar rung or dip on a side of the kayak.

2. Description of the Prior Art

There have long been floatation garments equipped with blocks or stacked panels of buoyant material contained between garment layers. These garments tend to be cumbersome and ill fitting and the buoyant blocks and panels tend to be hulk and awkward and to inhibit smooth and efficient movement of a wearer trying to swim.

Several patents appear to teach large blocks of buoyant material fitted to fixed and specific locations within the garments. Ikenaga, at al., U.S. Pat. No. 6,910,224, issued on Jun. 28, 2005 discloses an article of clothing with blocks of buoyant material sections fitted into pockets. Gilmer, U.S. Pat. No. 7,226,330 issued on Jun. 5, 2007 reveals a flotation swimsuit and method of construction of the swimsuit. Meredith, U.S. Pat. No. 5,459,874 issued on Oct. 24, 1995 teaches construction of floatation swimsuits into which thaw pads can be inserted at a variety of fixed locations using a special tool. Michalochick, et al U.S. Pat. No. 5,184,968, issued on Feb. 9, 1993, discloses floatation swim wear in the form of a one-piece swimsuit has a lower pants portion and a two-ply upper portion with a one-piece floatation member between plies of the swimsuit.

Other variations include Johnson et al., U.S. Pat. No. 6,986,691 issued on Jan. 17, 2006, which teaches foam stabilization for a personal flotation device in the form of a flotation vest containing a series of layers of flexible foam material held together fabric bands, and Khanamirian, U.S. Patent Publication Number 2001/0051478, published on Dec. 13, 2001, which discloses a personal floatation device with adjusting flotation layers.

It is thus an object of the present invention to provide a floatation garment which form fits closely to the body and has buoyant members which are compact and numerous, rather than bulky and awkward to use, and which are interconnected by elastic, bendable fabric, so that swimming movements of the wearer are free and uninhibited.

It is another object of the present invention to provide such a garment having buoyant members in the form of upright ribs, or panels within elastic stretchable material to fit the body closely.

It is yet another object of the present invention to provide such a garment which can be opened to a fixed extent along its sides into substantially an L-shape to define a buoyant float chair configuration of the invention.

It is a still further another object of the present invention to provide such a garment which to can be opened to a fixed extent along its sides into substantially an L-shape and secured to adjacent opposing sides of a kayak or other vessel to become and define a vessel seat cushion or seat.

It is finally an object of the present invention to provide such a garment which is relatively inexpensive to manufacture and aesthetically pleasing.

SUMMARY OF THE INVENTION

The present invention accomplishes the above-stated objectives, as well as others, as may be determined by a fair reading and interpretation of the entire specification.

A floatation garment is provided, including a garment front sheet having a wider forward sheet portion with a series of front buoyant member pockets within each of which a front buoyant member is retained, the front garment sheet tapering downwardly at its lower end; upper and lower front sheet straps extending laterally from the front sheet and have fastening mechanisms at their free ends; a garment rear sheet having a series of rear buoyant member pockets each containing a rear buoyant member, the garment rear sheet also tapering downwardly from its lower end and meets and connects to the tapered lower end of the garment front sheet to define a connecting segment for passing front to back between the wearer legs; and upper and lower rear sheet securing straps extending laterally from the rear sheet, the rear sheet securing strap having a rear strap connection means at opposing strap ends positioned to connect to corresponding front strap connection means so that to put on said garment a wearer places said connecting segment between wearer legs with said front sheet extending in front of the wearer and the rear sheet extending in back of the wearer, and then pivots said front sheet upwardly against the wearer abdomen and the rear sheet upwardly against the wearer back to define two leg openings on opposing sides of the connecting segment fitted around the wearer legs, and the corresponding and adjacent to the front and rear strap connection means are then interconnected.

The front are rear sheets preferably are formed of elastic material. The elastic material comprises neoprene or similar material.

The garment buoyant members and member pockets extend in parallel and spaced apart upper and lower series; so that upper and lower series permit the front sheet to bend along a horizontal line between buoyant members to permit a wearer to bend forward at the waist.

The front sheet straps and rear sheet straps when interconnected with their front and rear strap connection mechanisms preferably are extendable so that the garment can be opened and locked to a point at which the front sheet and rear sheet extend substantially at 90 degrees relative to each other such that the garment defines a float chair and a person can rest and recline in the float chair as it floats in water by sitting, against the connecting segment, while placing his or her back against the rear garment sheet and his or her upper legs on the front garment sheet.

The garment preferably can be configured as a kayak chair as it rests on the floor of a kayak, additionally including a series of kayak strap loops fastened to the back surface of the rear sheet; a kayak strap of sufficient length to pass through the series of strap loops and extend from either side of the garment to the upper sides of the kayak, each end of the kayak strap including a fastening mechanism for clipping to an oar rung on a side of the kayak.

The front sheet preferably is shorter than the rear sheet and terminates between the chest and abdominal area of the wearer below the level of the rear sheet so that the wearer is unrestricted in bending at the waist. The ability to bend is also provided by the separation of the blocks into upper and lower series, so that the garment can bend along a line between the upper and lower series, or is provided by another suitable configuration of the blocks.

The front buoyant members preferably collectively have greater buoyancy than the rear buoyant members to cause a wearer to float face upright for greater safety if unconscious in the water.

The front sheet preferably terminates in a generally horizontal upper edge, and the rear sheet preferably terminates in an upwardly arched upper edge. The front and rear strap connection mechanisms preferably include quick release buckles.

Connection straps and clasps preferably are provided for front rope connections.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
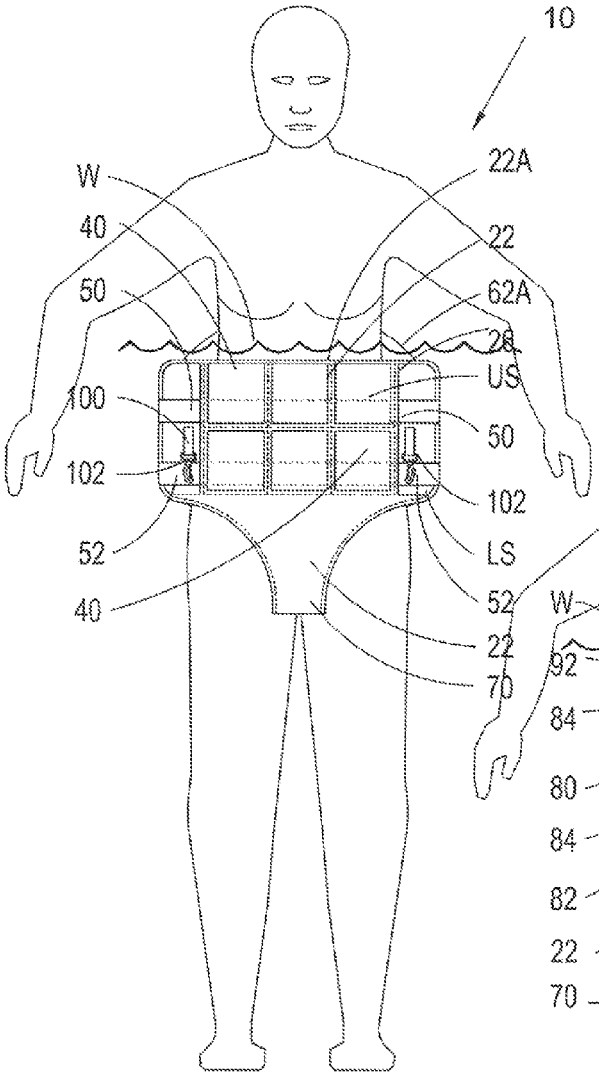
FIG. 1 is a front view of the floatation garment being worn by and buoying a person who is floating in water.
Figure 2:
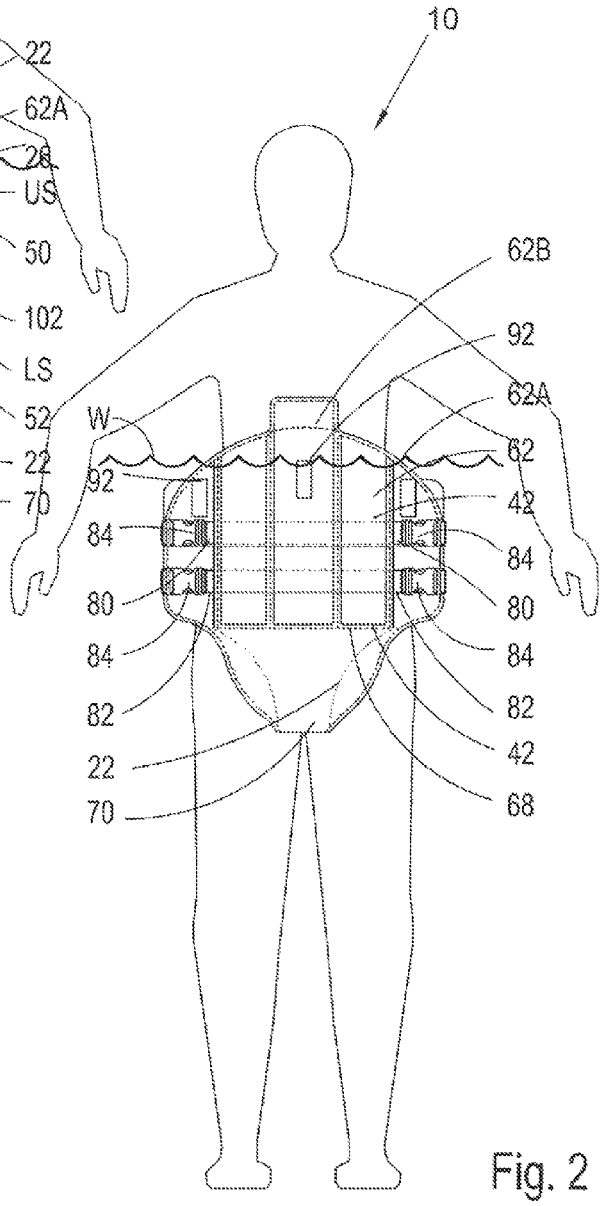
FIG. 2 is a rear view of the garment and person of FIG. 1.
Figure 3:
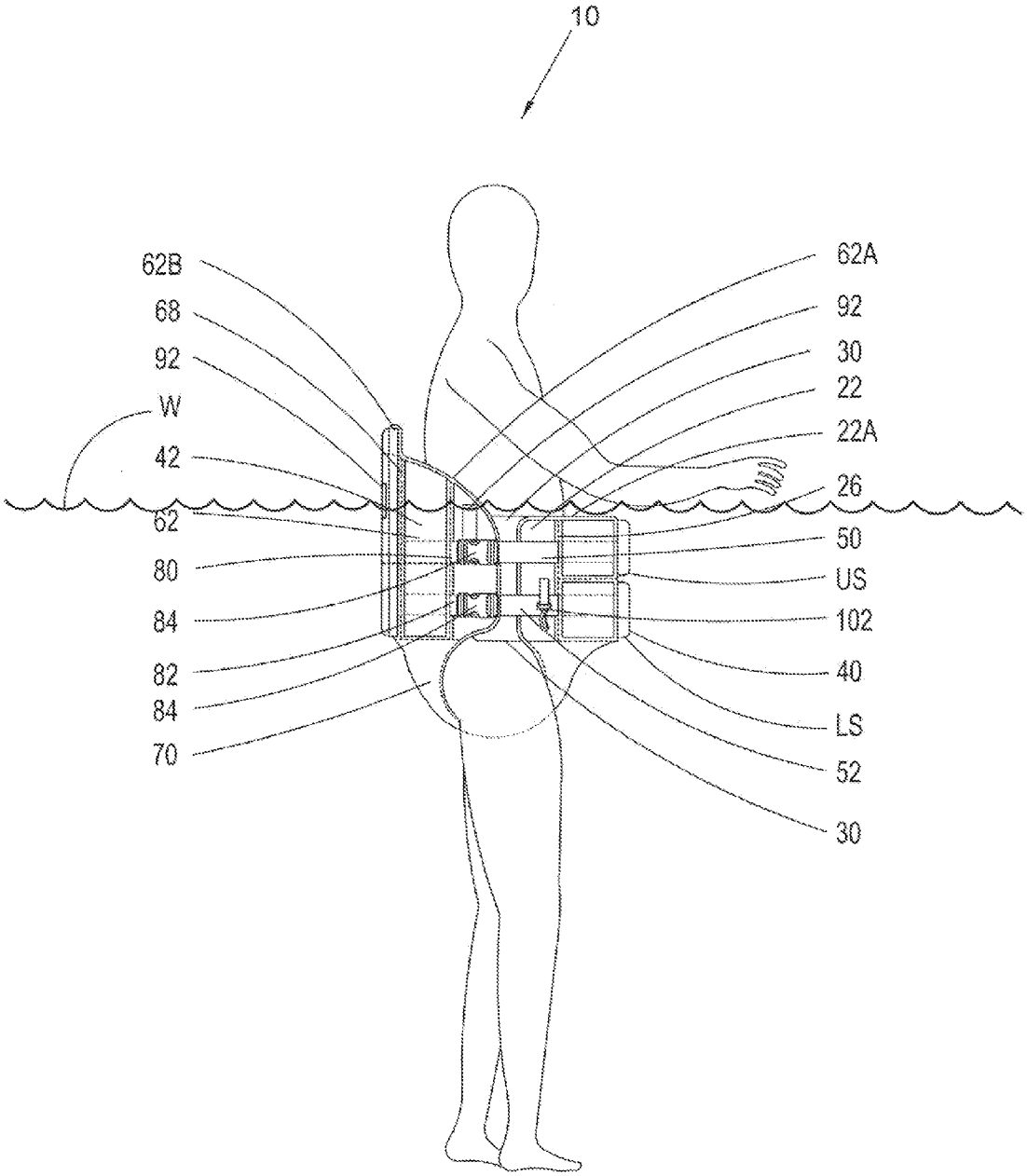
FIG. 3 is a side view of the garment of FIGS. 1 and 2, showing the strap connection mechanisms.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, hut merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1-16, a floatation garment 10 is disclosed including a garment front sheet 22 of elastic material E such as neoprene and having a wider forward sheet portion 22A with a series of front buoyant member pockets 26 within each of which a front buoyant member 40 is retained, the front garment sheet 22 tapering downwardly at its lower end. The front buoyant members 40 and their member pockets 26 preferably are provided in parallel and spaced apart upper and lower series US and LS, respectively, the upper and lower series US and LS permit the front sheet 22 to bend along a horizontal line between the series US and LS to permit the wearer to bend forward at the waist. The garment 10 further includes a garment rear sheet 62 preferably of the same stretchable and resilient material E as the front sheet 22 and having a single series of rear buoyant member pockets 68 each containing a rear buoyant member 42 which preferably is at least as tall as two of the front buoyant members 40 combined. Only a single, taller series RS of rear buoyant members 42 is provided because a wearer cannot bend substantially rearwardly at the waist. The garment rear sheet 62 also tapers downwardly from its lower end and meets and connects to the tapered lower end of the garment front sheet 22 to define a connecting segment 70 for passing front to back between the wearer legs, preferably integral with the front and rear sheets 22 and 62 to define a single, continuous garment sheet.

It is preferred that a neoprene flap 30 be provided, preferably connected to and extending rearwardly from each lateral end of the front sheet 22, and extending entirely across the gap between the opposing lateral ends of front sheet 22 and rear sheet 52. See FIGS. 3 and 9. These left and right neoprene flaps 30 shield the wearer, particularly the larger wearer, from rubbing and abrasion of the straps 50 and 52 and any resultant soreness or rash.

Upper and lower front sheet straps 50 and 52, respectively, extend generally horizontally across and laterally from the front sheet 22 and have fastening mechanisms 54 such as buckles or clasps at their free ends. Upper and lower rear sheet securing straps 80 and 82, respectively, extend generally horizontally across and laterally from the rear sheet 62. Each rear sheet securing strap 80 and 82 has a rear strap connection mechanism 84 at opposing strap ends positioned to connect to corresponding front strap connection mechanisms 54. The front and rear strap connection means 50 and 52, and 80 and 82 preferably are 1.5 inch heavy duty coated nylon belts with durable quick release buckles 84.

Figure 4:
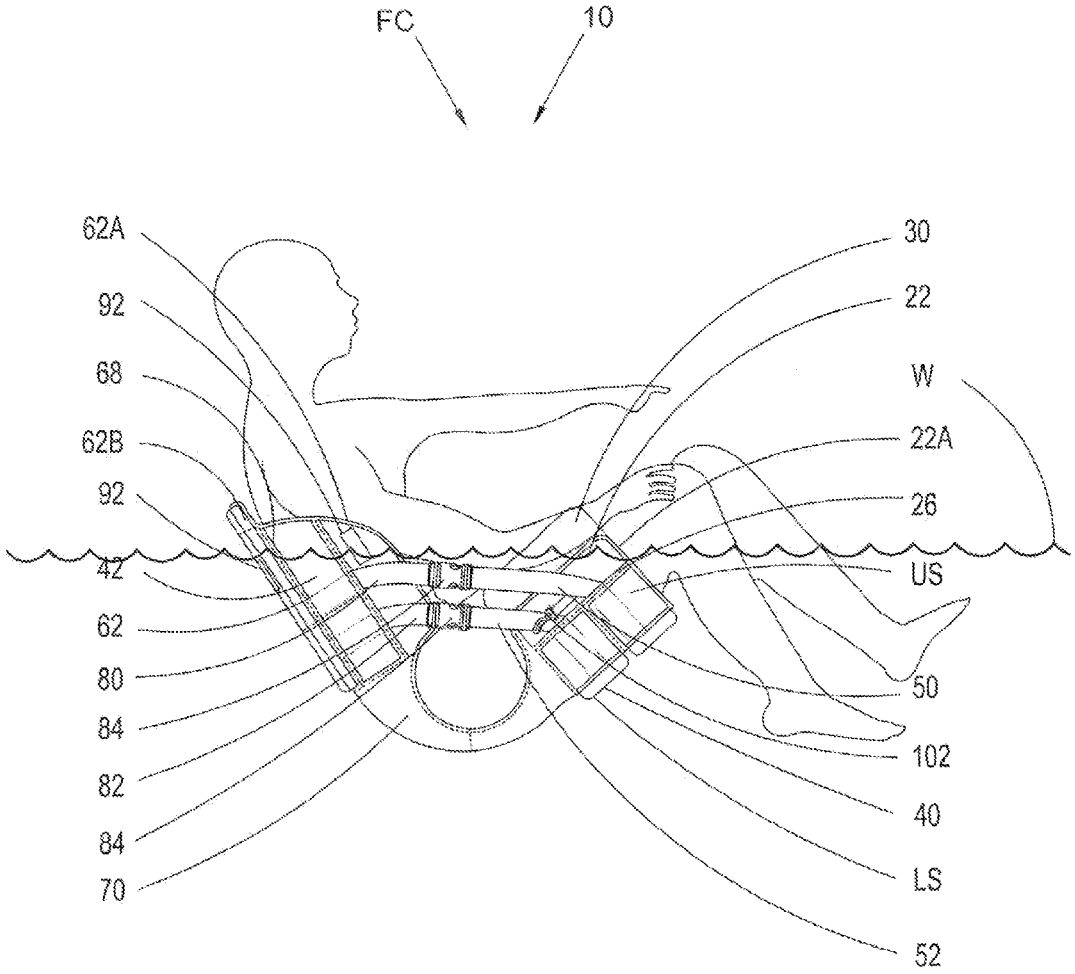
FIG. 4 is a side view of the garment of FIG. 3, showing the garment with the straps adjusted for greater length and distance between the front and rear sheets, converting the buoyant shorts into a buoyant chair, and showing a person seated in the chair as it floats.
Figure 5:
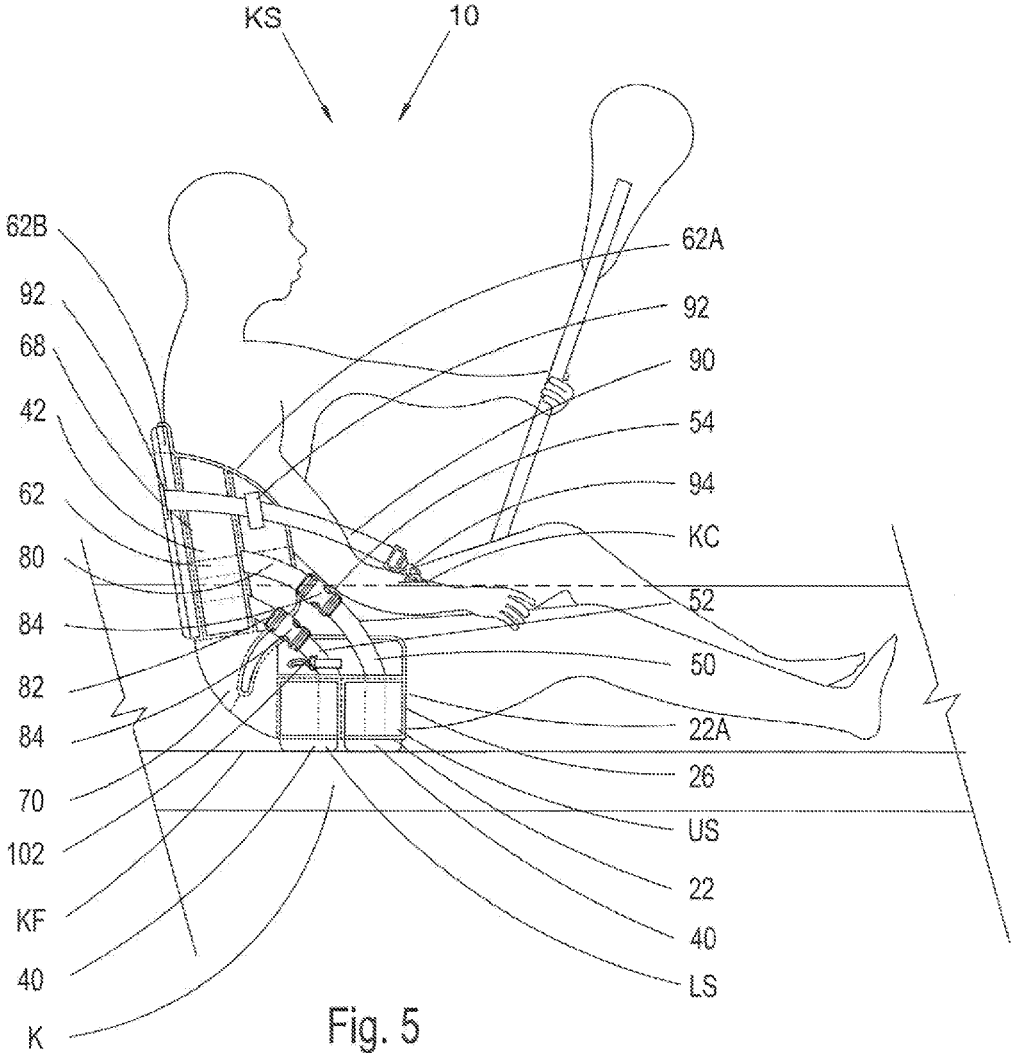
FIG. 5 is a side view of the garment of FIGS. 3 and 4, showing the garment with the front and rear sheets spaced apart to an approximate 90 degree relationship to define a kayak seat, and a kayak snap passing through loops on the garment and the strap ends secured to sides of a kayak with releasable fasteners, and a showing person properly seated in the kayak seat.
Figure 6:
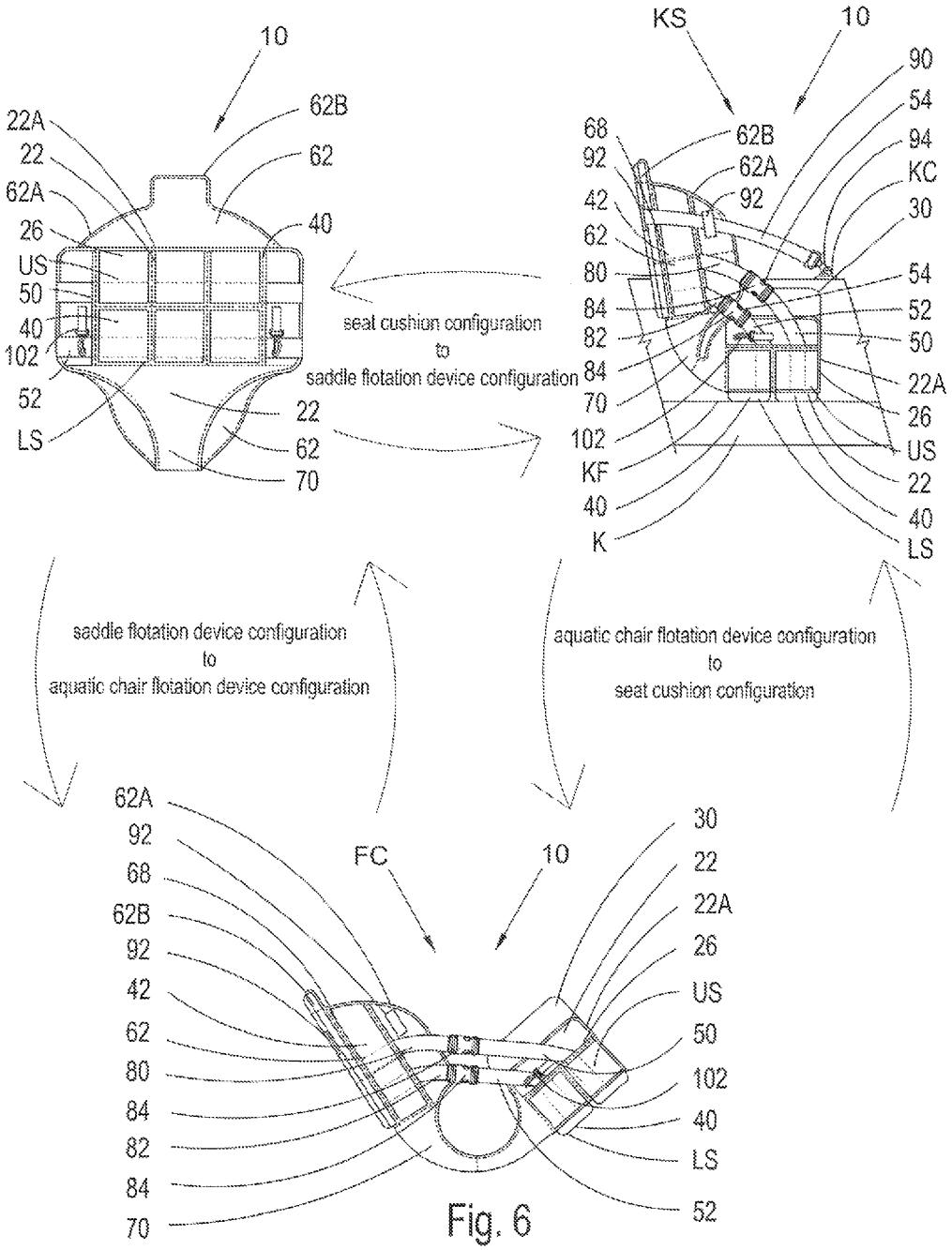
FIG. 6 shows three configurations garment of FIGS. 1-5, namely saddle flotation device to aquatic chair flotation device to seat cushion flotation device, and indicates the conversion from one configuration to the next.
Figure 7:
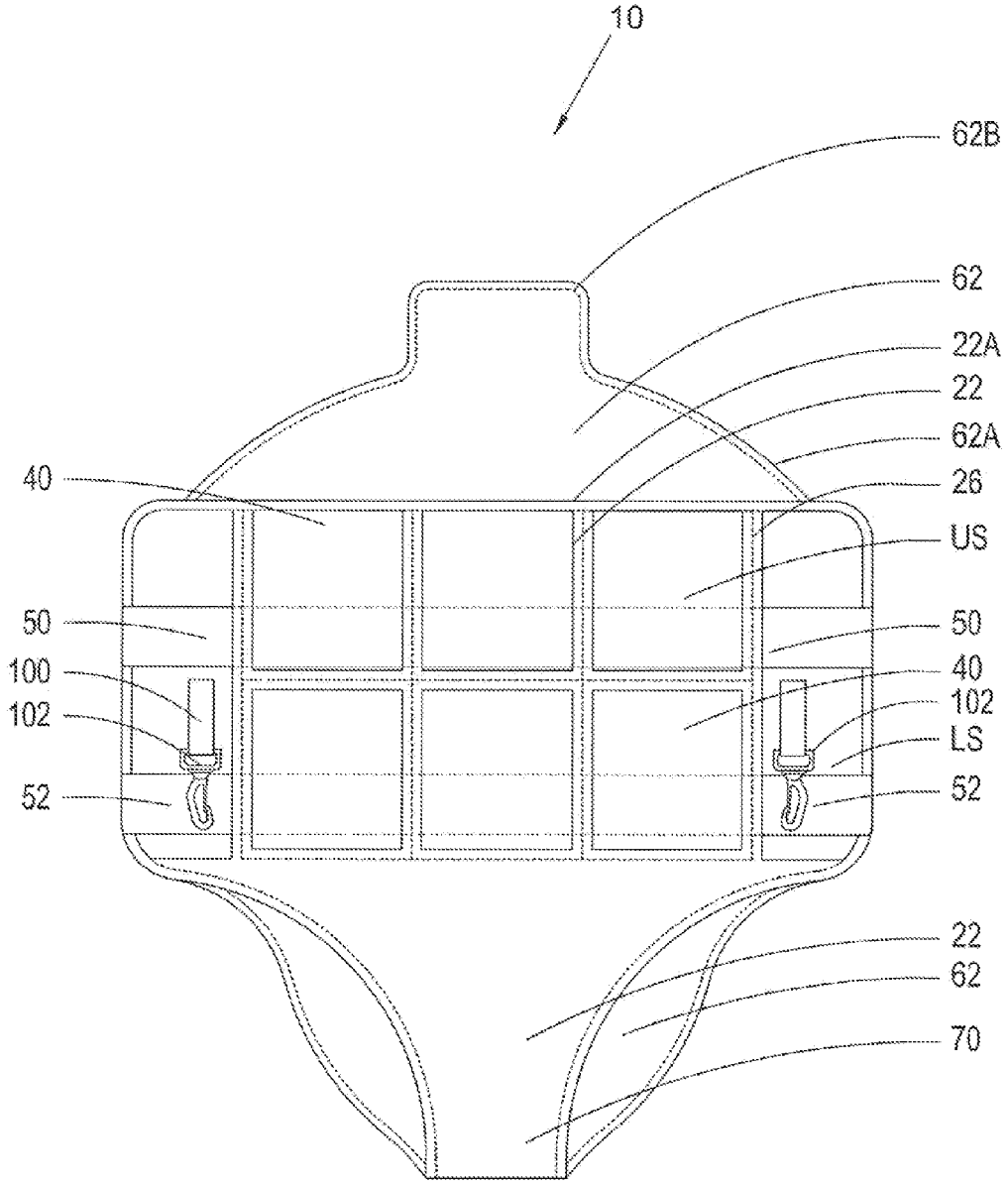
FIG. 7 is a close-up front view of the garment in its shorts or saddle configuration as in FIG. 1.
Figure 8:
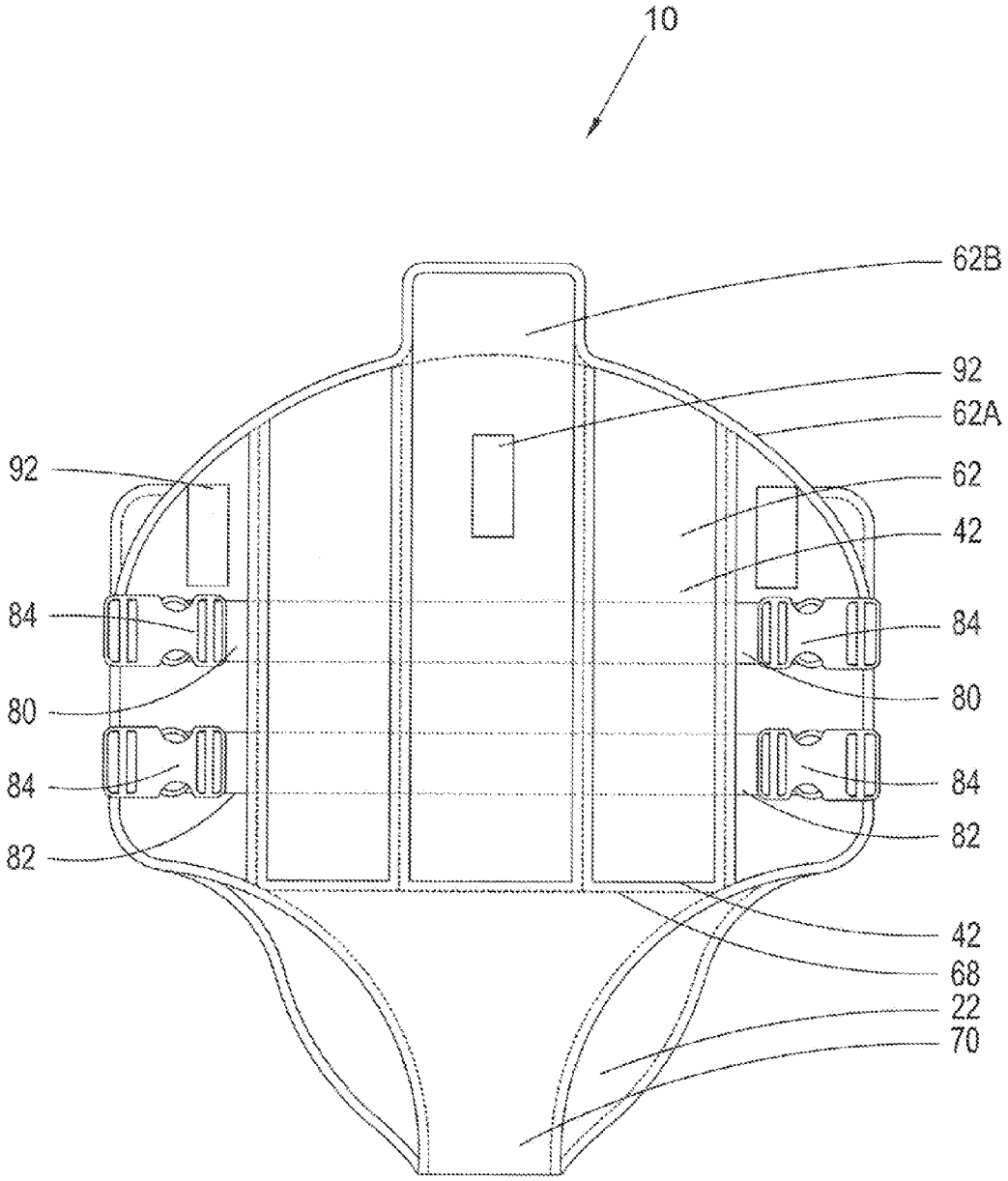
FIG. 8 is a close-up rear view of the garment as in FIG. 2.
Figure 9:
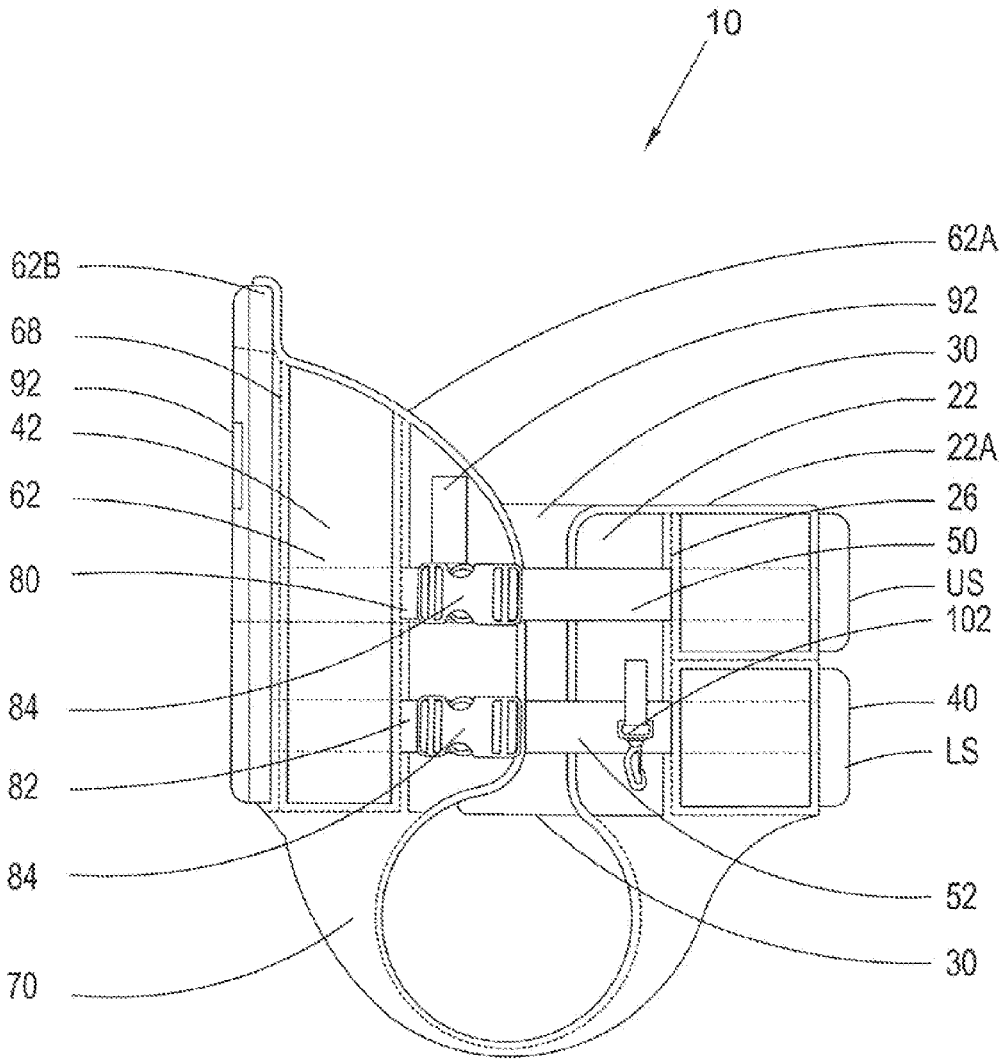
FIG. 9 is a close-up side view of the garment as in FIG. 3.
Figure 10:
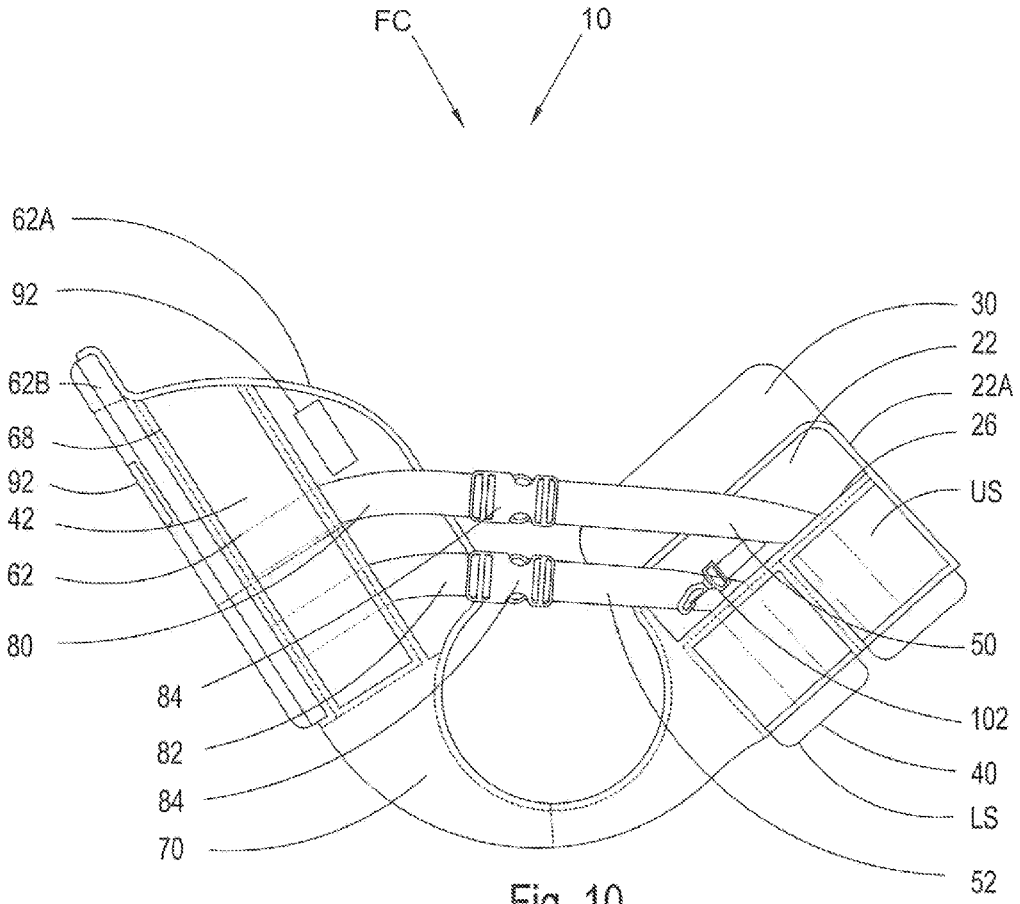
FIG. 10 is a close-up view of the garment in its flotation chair configuration as in FIG. 4.
Figure 11:
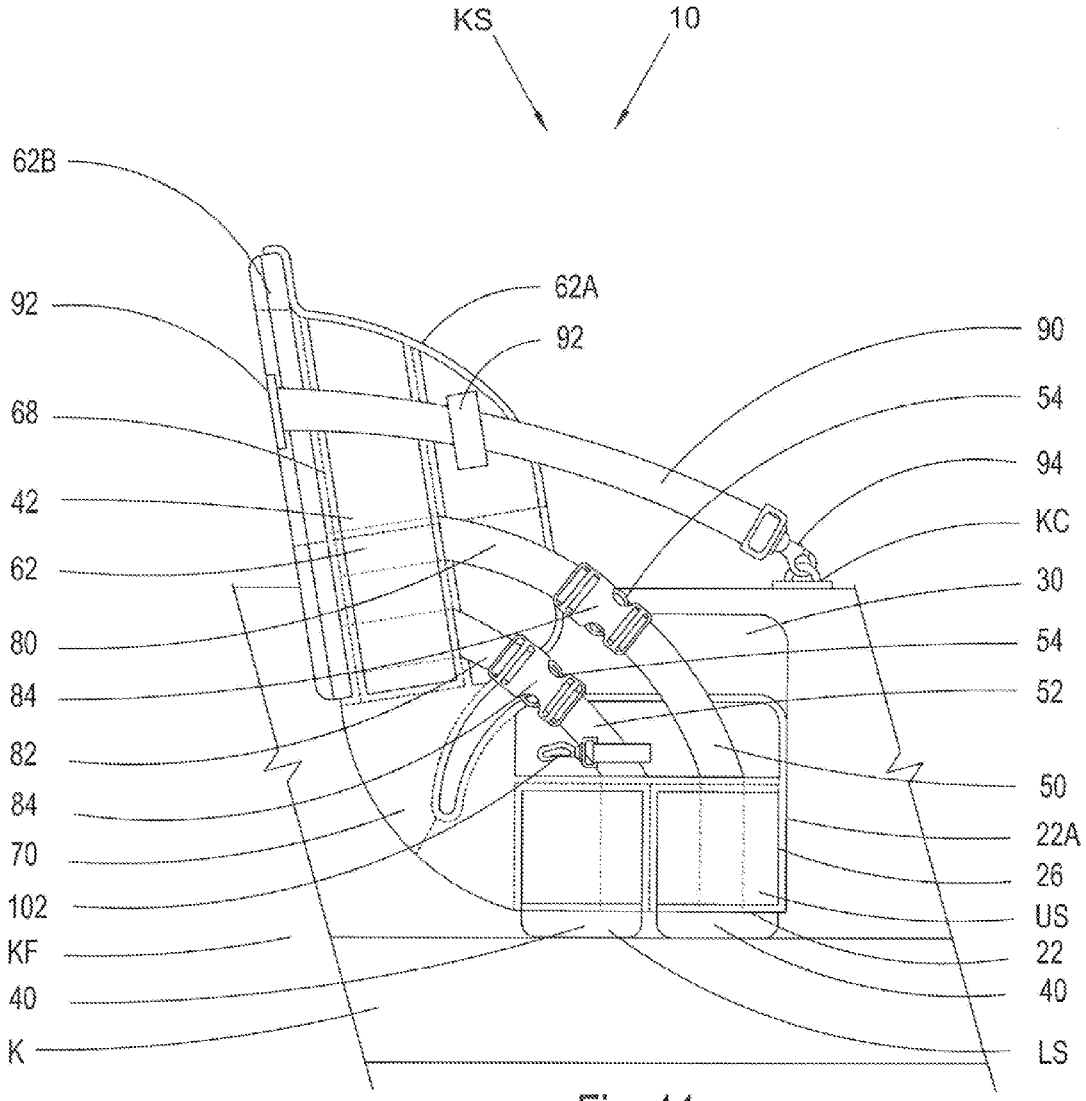
FIG. 11 is a close-up view of the garment in its kayak configuration as in FIG. 5.
Figure 12:
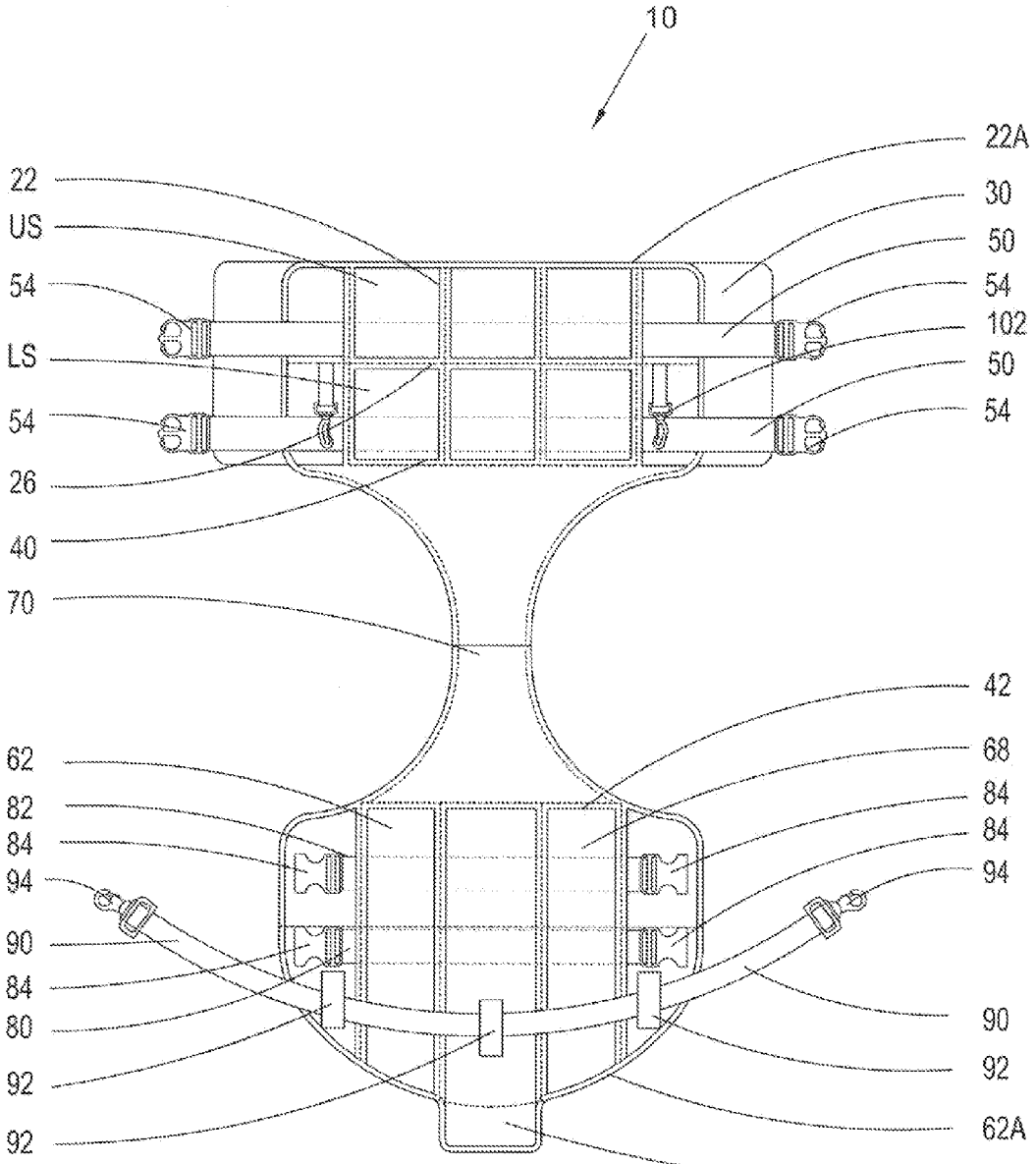
FIG. 12 is a plan view of the garment opened frilly into a planar configuration, fully illustrating the connecting segment interconnecting the front and rear sheets.
Figure 13:
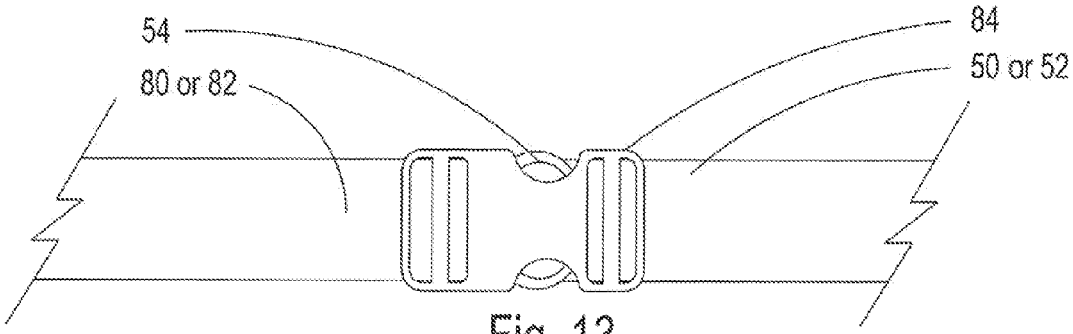
FIG. 13 is a broken away view of one of the garment straps and a preferred connecting mechanism releasing connecting strap ends.
Figure 14:
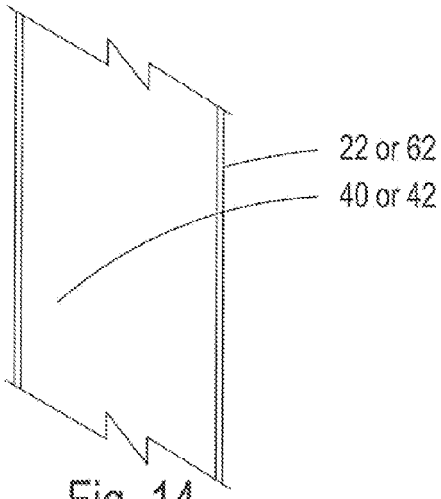
FIG. 14 shows either front or rear buoyant members secured to front or rear sheets, respectively.
Figure 15:
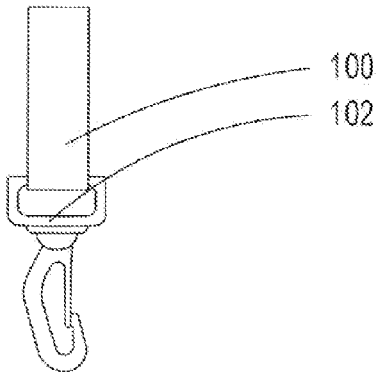
FIG. 15 is shows an end of an accessory strap and its clip for securing the garment to future products to the garment.
Figure 16:
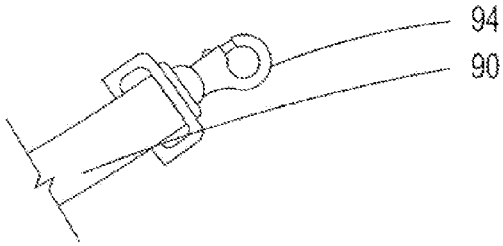
FIG. 16 shows an end of the kayak strap and its fastening mechanism for securing the garment to a kayak.

The respectively interconnected front sheet straps 50 and 52 and rear sheet straps 80 and 82 preferably are extendable by releasing an extra length of each of the straps 50 and 52 at side buckles 84 as in so that the garment 10 can be opened by pivoting front and rear garment sheets 22 and 62 away from each other as in FIG. 12, and the straps 50 and 52 then locked by the grip of the buckles 84 on the straps 50 and 52 at a point at which the front sheet 22 and rear sheet 62 extend substantially at 90 degrees relative to each other so that the garment 10 opens to a specific extent to define a float chair FC, as shown in FIG. 4. Alternatively, garment 10 can be opened by releasing an extra length of each of the straps 80 and 82 at side buckles 84. A person can recline and rest in float chair FC as it floats in water, as shown, while seated on connecting segment 70, with his or her back resting against rear garment sheet 62 and upper legs resting against front garment sheet 22. FIG. 4 shows with respect to the water line_how the chair FC floats while occupied.

Another feature is provided to secure the float chair FC as it rests on the floor KF of a kayak K so that it becomes a kayak seat KS. See FIG. 5. A series of kayak strap loops 92 preferably are fastened to the hack surface of the rear sheet 62. A kayak strap 90 is provided of sufficient length to pass through the series of strap loops 92 and extend from either side of the garment 10 to the upper sides of a kayak K. Each end of the kayak strap 90 includes a kayak strap fastening mechanism 94 for clipping to an oar rung or clip KC on a side of the kayak K.

The front sheet 22 preferably is shorter than the rear panel 60 and terminates between the chest and abdominal area of the wearer below the level of the rear sheet 62 so that the wearer is further unrestricted in bending at the waist. Greater buoyancy is provided in the front sheet 22, and thus toward the front side of the wearer, to keep the wearer more face upright in the water for greater safety. To achieve this buoyancy differential, the front buoyancy members 40 preferably are thicker than the rear buoyancy members 42, the members 40 and 42 preferably being formed of soft foam blocks or panels such as PVC foam, or EPE foam or other types of suitable material. The front sheet 22 preferably terminates in a generally horizontal upper edge 20A, and the rear sheet 62 preferably terminates in an upwardly arched upper edge 62A. The arched upper edge 60A preferably includes a centrally positioned upward bobber protrusion tab 62B both to provide additional wearer back support and to cause the outline of the garment 10 to resemble the side view of a fishing bobber float, a trademark style feature of the present invention.

To put on floatation garment 10, a wearer places the connecting segment 70 between wearer legs with the front sheet 22 extending in front of the wearer and the rear sheet 62 extending in back of the wearer. Then, with the connecting segment 70 passing closely adjacent to the wearer crotch, the front sheet 22 is pivoted upwardly against the wearer abdomen and the rear sheet 62 is pivoted upwardly against the wearer back to define two leg openings L1 and L2 fitted around the wearer legs, and the corresponding and adjacent to the front and rear strap connection means 54 and 84 are interconnected.

Accessory clips 100 and 102 optionally are provided on garment 10 for securing the garment to future products.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A floatation garment, comprising:

a garment front sheet having a wider forward sheet portion with parallel and spaced apart upper and lower series of front buoyant member pockets within each of which a front buoyant member is retained, such that the positions of said upper and lower series of front buoyant pockets containing front buoyant members and the spacing between said upper and lower series permit said front sheet to bend along a horizontal line between buoyant members to permit a wearer to bend forward at the waist, the front garment sheet tapering downwardly at its lower end;

a garment rear sheet having parallel and spaced apart upper and lower series of rear buoyant member pockets each containing a rear buoyant member, said garment rear sheet also tapering downwardly from its lower end and meets and connects to the tapered lower end of the garment front sheet to define a connecting segment for passing front to back between the wearer legs;

sheet interconnection means for releasibly and laterally interconnecting said garment front sheet and said garment rear sheet and having sheet interconnection means fastening means;

such that to put on said garment a wearer places said connecting segment between wearer legs with said front sheet extending in front of the wearer and said rear sheet extending in back of the wearer, and then pivots said front sheet upwardly against the wearer abdomen and said rear sheet upwardly against the wearer back to define two leg openings on opposing sides of said connecting segment fitted around the wearer legs, and the corresponding and said sheet interconnection means is operated to laterally interconnect said front sheet and said rear sheet.

2. The garment of claim 1, wherein said front and rear sheets are formed of elastic material.

3. The garment of claim 2, wherein said elastic material comprises neoprene.

4. The garment of claim 1, wherein said sheet interconnection means comprises upper and lower front sheet straps extending laterally from said front sheet and having fastening mechanisms at their free ends;

and upper and lower rear sheet securing straps extending laterally from said rear sheet, said rear sheet securing strap having a rear strap connection means at opposing strap ends positioned to connect to corresponding front strap connection means.

5. A floatation garment, comprising:

a garment front sheet having a wider forward sheet portion with a series of front buoyant member pockets within each of which a front buoyant member is retained, the front garment sheet tapering downwardly at its lower end;

a front sheet strap having front sheet strap free ends and extending laterally from said front sheet and having front sheet strap fastening means at said front sheet strap free ends;

a garment rear sheet having a series of rear buoyant member pockets each containing a rear buoyant member, said garment rear sheet also tapering downwardly from its lower end and meets and connects to the tapered lower end of the garment front sheet to define a connecting segment for passing front to back between the wearer legs;

a rear sheet securing strap having rear strap free ends and extending laterally from said rear sheet, and strap connection means for releasibly interconnecting said front sheet strap free ends and said rear sheet strap free ends;

such that to put on said garment a wearer places said connecting segment between wearer legs with said front sheet extending in front of the wearer and said rear sheet extending in back of the wearer, and then pivots said front sheet upwardly against the wearer abdomen and said rear sheet upwardly against the wearer back to define two leg openings on opposing sides of said connecting segment fitted around the wearer legs, and said strap interconnection means is operated to interconnect said front sheet strap and said rear sheet strap free ends;

wherein said front sheet straps and rear sheet straps when interconnected with their front and rear strap connection means are extendable such that said garment can be opened and locked to a point at which the front sheet and rear sheet extend substantially at 90 degrees relative to each other such that the garment defines a float chair and a person can sit in the float chair as it floats in water.

6. A floatation garment, comprising:

a garment front sheet having a wider forward sheet portion with a series of front buoyant member pockets within each of which a front buoyant member is retained, the front garment sheet tapering downwardly at its lower end;

a front sheet strap having front sheet strap free ends and extending laterally from said front sheet and having front sheet strap fastening means at said front sheet strap free ends;

a garment rear sheet having a series of rear buoyant member pockets each containing a rear buoyant member, said garment rear sheet also tapering downwardly from its lower end and meets and connects to the tapered lower end of the garment front sheet to define a connecting segment for passing front to back between the wearer legs;

a rear sheet securing strap having rear strap free ends and extending laterally from said rear sheet, and strap connection means for releasibly interconnecting said front sheet strap free ends and said rear sheet strap free ends;

such that to put on said garment a wearer places said connecting segment between wearer legs with said front sheet extending in front of the wearer and said rear sheet extending in back of the wearer, and then pivots said front sheet upwardly against the wearer abdomen and said rear sheet upwardly against the wearer back to define two leg openings on opposing sides of said connecting segment fitted around the wearer legs, and said strap interconnection means is operated to interconnect said front sheet strap and said rear sheet strap free ends;

wherein said garment can be configured as a chair as it rests on the floor of a kayak, additionally comprising:

at least one kayak strap loop fastened to the back surface of said rear sheet;

and a kayak strap having kayak strap ends and being of sufficient length to pass through said at least one kayak strap loop and extend from either side of the garment to the upper sides of the kayak, each said kayak strap end including a fastening mechanism for clipping to an oar rung on a side of the kayak.

7. The garment of claim 1, wherein said front sheet terminates between the chest and abdominal area of the wearer below the level of said rear sheet such that the wearer is unrestricted in bending at the waist.

8. The garment of claim 1, wherein said front buoyant members collectively have greater buoyancy that said rear buoyant members to cause a wearer to float face upright for greater safety.

9. The garment of claim 1, wherein said front sheet terminates in a generally horizontal upper edge, and said rear sheet terminates in an upwardly arched upper edge.

10. The garment of claim 1, wherein said front and rear strap connection means comprise quick release buckles.

* * * * *